United States Patent [19]

McConnell

[11] 4,329,552

[45] May 11, 1982

[54] WIRE FORMED INTERLEAVED SPRING CONTACT STRUCTURE

[75] Inventor: Lorne D. McConnell, Chalfont, Pa.

[73] Assignee: Gould Inc., Rolling Meadows, Ill.

[21] Appl. No.: 143,038

[22] Filed: Apr. 23, 1980

[51] Int. Cl.[3] ..... H01H 33/14

[52] U.S. Cl. ..... 200/147 R; 200/144 R; 200/275; 339/258 R

[58] Field of Search ..... 200/147, 275, 281, 283, 200/144

[56] References Cited

U.S. PATENT DOCUMENTS

| | | | |
|---|---|---|---|
| 1,337,628 | 4/1920 | Townsend | 200/275 |
| 2,695,350 | 11/1954 | Schultz | 200/275 |
| 2,922,013 | 1/1960 | Huffman | 200/275 |
| 3,157,770 | 11/1964 | Beaulieu | 200/275 |
| 4,249,052 | 2/1981 | Votta et al. | 200/147 R |

*Primary Examiner*—Robert S. Macon

*Attorney, Agent, or Firm*—Ostrolenk, Faber, Gerb & Soffen

[57] ABSTRACT

A contact structure for a circuit interrupter consists of a cylindrical cluster of spring wire members, each having a U shape with axially inwardly reentrantly bent tips at the base of the U shapes. Alternate members in the cylindrical cluster have their reentrant sections axially displaced from one another so that the tips of alternate members terminate in spaced first and second planes which are perpendicular to the axis of the cylindrical cluster. The two sets of wire members are interleaved, whereby the longer fingers straddle the legs of the shorter members, thereby defining two internal contact regions at the base of the two reentrant bent sections.

11 Claims, 8 Drawing Figures

WIRE FORMED INTERLEAVED SPRING CONTACT STRUCTURE

BACKGROUND OF THE INVENTION

This invention relates to a novel spring wire contact assembly, and more specifically relates to a novel spring wire contact assembly which has particular use in connection with an arc spinner type of circuit interrupter.

Arc spinner circuit interrupters are well known and are shown, for example, in U.S. Pat. Nos. 4,052,576 and 4,079,219. The movable contact structure used in these devices is a cylindrical contact finger assembly made from a single piece of tubular material which has been machined and segmented by mill cutting. Such contact structures are also shown in U.S. Pat. No. 4,142,560. This main contact assembly then telescopes over a cooperating contact assembly and contact pressure is obtained by the forces required to flex the individual fingers outwardly during the contact engagement operation. A one-piece machined cylinder for a movable contact is expensive and numerous problems arise when using the resulting contact structure.

It is known that the single machined cylinder for a movable contact structure can be replaced by a cluster of wire fingers, as shown in U.S. Pat. No. 4,072,392, entitled "Spring Wire Formed Tulip Contact", in the names of McConnell and Kucharski and assigned to the assignee of the present invention.

However, the use of the spring wire fingers shown in U.S. Pat. No. 4,072,392 does not lend itself directly to use with arc spinner interrupters of the type shown in U.S. Pat. No. 4,052,576 which require a main contact area as well as a current transfer region connected to the main movable contact but removed from the main contact area. Moreover, the assembly of the spring wire element of U.S. Pat. No. 4,072,392 is complex because it requires the handling of many individual elements, while the use of a single, continuous bent wire produces serious fabrication problems.

BRIEF DESCRIPTION OF THE INVENTION

In accordance with the present invention, a novel spring wire contact assembly is formed which can be used in connection with arc spinner interrupters as well as with other circuit interrupter applications, wherein the spring wire members forming the tubular cluster have a hairpin or U shape. The base of the U shape contains a flat reentrant bend extending inwardly toward the axis of the cluster. The alternate U-shaped members of the cluster terminate at different axial locations so that the members having the longer axial location straddle over the legs of adjacent U-shaped members to form a tight cluster, with the reentrant sections of the alternate contact members forming two contact ring regions which are axially spaced. The endmost of the contact ring regions can serve as the main contact region of an arc spinner interrupter, while the axially shorter of the two regions can serve as the transfer contact region, as will be later described.

The novel spring wire arrangement of the present invention provides numerous benefits over the machined and mill-cut, one-piece contact including:

1. The material employed can be chrome-copper or beryllium-copper, which have better contact properties and are more consistent in their physical properties than materials used in the machined one-piece contact.

2. The contact materials can be selected from standard production runs, and tooling and stock requirements are fewer and less expensive.

3. The wire members can have any cross-section and can be formed of round, square or rectangular stock and can be formed by conventional wire-forming and spring-manufacturing techniques, which will produce very consistent spring finger characteristics, as compared to the characteristics obtained from material which is machined, cast or hot-forged. Preferably, the wire cross-section is round.

4. The use of a small wire size produces a very large number of contact points around the tubular cluster and a large number of parallel current paths, thereby reducing the current transfer per point during commutation.

5. The contact assembly will have relatively small mass, producing a very much higher dynamic frequency response and higher natural frequency of vibration for the contacts than those obtained with machined one-piece parts.

6. All high-stress rise points which are present in the mill-cut fingers at the cut edges and slot bottom of the presently machined one-piece part are eliminated to allow a more accurate definition of stresses so that the spring wire parts can be worked to a higher level, while retaining an assured safety margin.

7. The use of the spring wire material permits the use of a shorter finger length to further reduce dynamic problems and vibration problems.

DETAILED DESCRIPTION OF THE DRAWINGS

Figure 1:
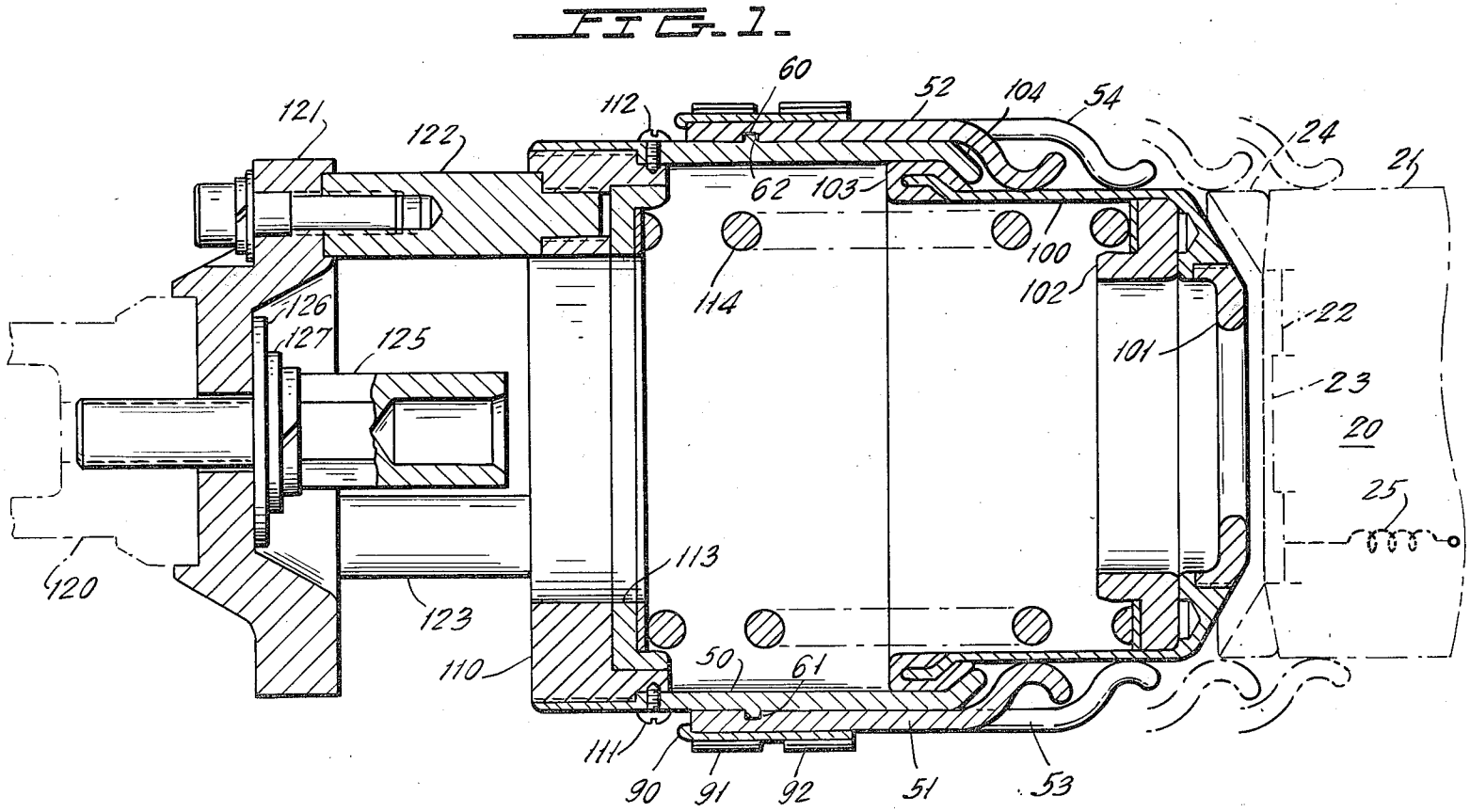
FIG. 1 is a cross-sectional diagram of the novel contact assembly of the present invention.

FIG. 1 illustrates the invention as applied to the moving contact assembly of an arc spinner interrupter which may be of the type shown in U.S. patent application Ser. No. 868,622 [C-1848 (ER)], filed Jan. 11, 1978, in the name of Smith, entitled "Exterior Connected Arc Runner for Arc Spinner Interrupter", and assigned to the assignee of the present invention.

The fixed contact of the assembly is schematically shown in FIG. 1 as the fixed contact assembly 20, while the details of the fixed contact structure 20 are well known and are shown in application Ser. No. 868,622, which is incorporated herein by reference as a part of the specification.

It is sufficient for an understanding of the present invention to understand that the stationary contact structure has a main outer cylindrical contact surface 21 connected to the device main terminal, while internally of the main stationary contact structure there is an arcing ring 22 defined between a central Teflon insulation region 23 and an outer Teflon insulation ring 24. The arcing ring 22 is electrically connected in series with the arc spinner coil 25 in the usual manner of the arc spinner circuit interrupter.

Figures 2, 3, 4, 5, 6, 7, 8:
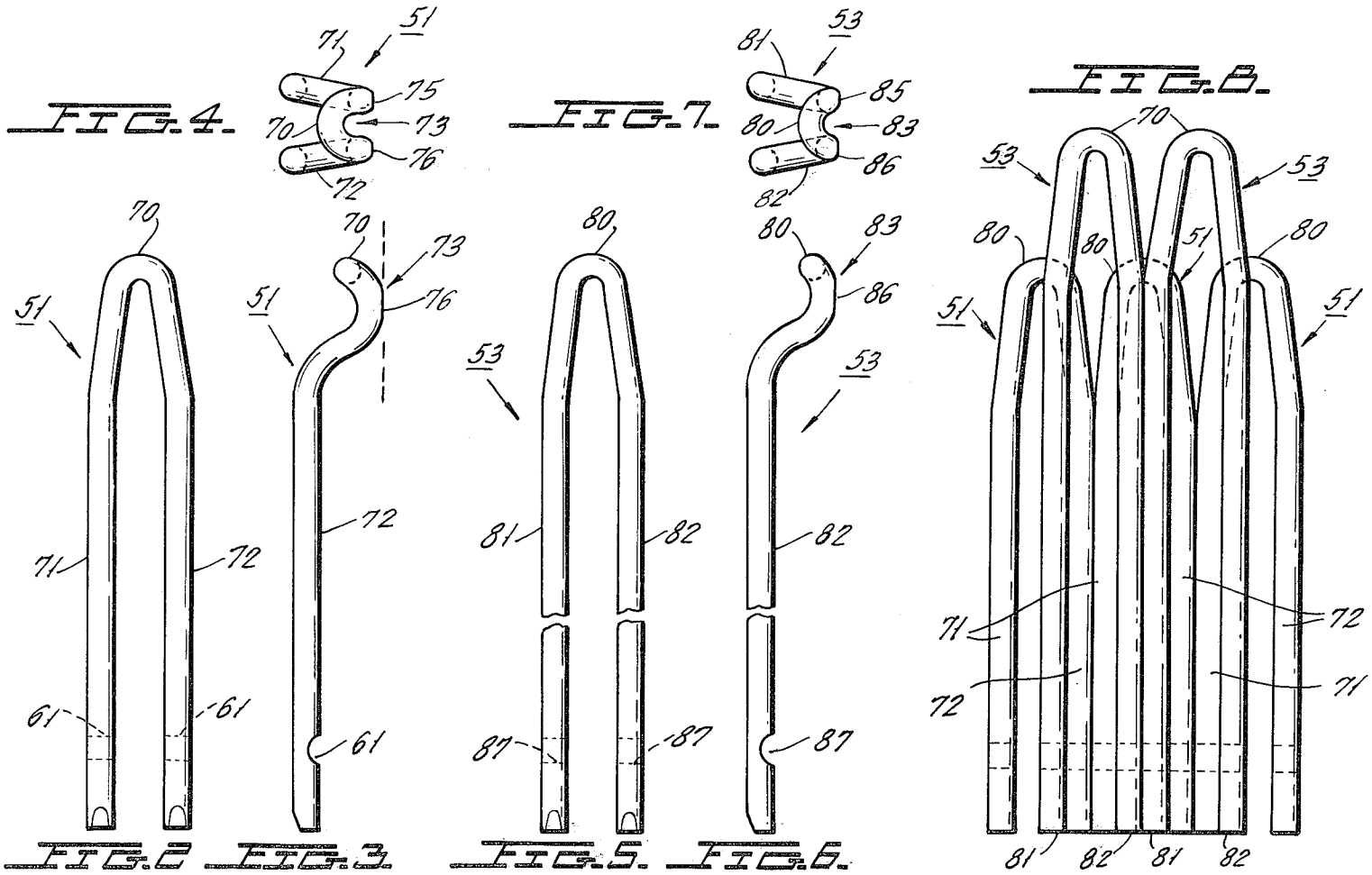
FIG. 2 is a plan view of one of the short contact fingers of FIG. 1.
FIG. 3 is a side view of FIG. 2.
FIG. 4 is an end view of FIG. 3.
FIG. 5 is a plan view of one of the longer fingers of FIG. 1.
FIG. 6 is a side view of FIG. 5.
FIG. 7 is an end view of FIG. 6.
FIG. 8 is a schematic view showing three short contacts and two interleaved adjacent long contacts in the flat to demonstrate the manner in which the contacts nest relative to one another.

The novel moving contact assembly of the invention consists of a cylindrical conductive support body 50 which supports, on its outer surface, two pluralities of interleaved spring wire members shown as the plurality of shorter members 51 and 52 in FIG. 1 and the longer members 53 and 54 in FIG. 1. The main support body 50 has a circular keying ridge 60 extending around its outer periphery, and this ridge receives cooperating keying depressions in each of the members, such as depressions 61 and 62 in members 51 and 52. The detailed structure of member 51 is shown in FIGS. 2, 3 and 4. The same structure is used for each alternate member in the cluster of FIG. 1.

Details of the structure of the longer members, such as member 53, are shown in FIGS. 5, 6 and 7. The material used for members 51 and 53 and all their counterparts in the cluster is, in the preferred embodiment of the present invention, a beryllium-copper having a round configuration with a diameter of 0.186 inch.

Member 51 consists of a hairpin-shaped or U-shaped member having a base region 70 from which two leg sections 71 and 72 extend. Notches 61 are formed in the legs 71 and 72. The base end of member 70 is then formed with the reentrant bend section 73. Contact flats 75 and 76 are then formed in the leg sections 71 and 72, respectively, at the bottom of the reentrant bend, where this contact flat will be described later. Typically, member 51 may have a length from end to end of about 3.42 inches. The "drop" distance from the upper surface of the member to the flats 75 and 76 typically may be about 0.68 inch.

The contact member 53 has almost the same shape as contact member 51 but is slightly modified to permit the nesting of the contacts, as will be later described. Thus, contact 53 has the hairpin or U shape having the base 80 from which extend legs 81 and 82, and the reentrant bend section 83. Note that the tip of the reentrant bend section 83 of contact member 53 does not rise to the same extent as that of reentrant bend 73 of contact 51. Contact flats 85 and 86 are placed on the sliding contact regions of legs 81 and 82, respectively, and correspond to the contact flats 75 and 76 of FIGS. 2, 3 and 4. Positioning keys 87 are also provided in the legs 81 and 82 to enable positioning relative to the ridge 62 in FIG. 1 of main support cylinder 52.

In a typical embodiment of the invention, the total length of the member 53 will be about 4.22 inches. The same diameter and the same material is used for the member 53 as was used for the member 51. The drop of the reentrant bend 83 in the member 81 is slightly less than that used for members 51 and typically may be about 0.64 inch. The use of the different drop permits the selection of different stress levels for the different length members.

FIG. 8 schematically illustrates the manner in which members, such as members 53, will be interleaved with the shorter members 51. Note that the spacing between the legs 71 and 72 of the members 51 is twice the thickness of the members. Thus, when interleaved into a common cylindrical shape, leg 82 and leg 81 of adjacent members 53 will completely fill the space between the legs 71 and 72 of the member receiving the legs 81 and 82. This is most clearly shown for the center elements of FIG. 8.

The individual contact members forming the complete circular cluster are fixed to the conductive member 50 by the metal hoop 90 shown in FIG. 1, which is tightened into place by appropriate cinch bands 91 and 92. Alternatively, an appropriate press fit or heat-shrink band could be used.

The structure described to this point can now be used as a sliding tubular contact for any circuit interrupter application. When used in connection with the arc spinner interrupter, additional components are applied to the novel structure, including internal arcing contact cylinder 100 which makes sliding engagement with the flats 75 and 76 of each of the shorter contacts 51 and flats 85 and 86 of each of the longer of the contact members. Note that these flats define respective contact rings at spaced axial locations around the cluster of contact finger elements. Arcing contact cylinder 100 contains an arcing contact ring 101 and a spring-pad ring 102. The left-hand end of cylinder 100 has an enlarged diameter region 103 which acts as a stop when it engages the inwardly turned end 104 of conductive cylinder 50. The left-hand end of cylinder 50 receives a mounting disc 110 which is threaded into member 50 and held in place as by set screws 111 and 112. Member 110 also carries a spring pad 113, and the compression spring 114 is contained between pressure pads 102 and 113, thereby to bias cylinder 100 to the right in FIG. 1.

The entire movable contact assembly is then connected to an appropriate operating rod 120 through a connecting member 121 which is connected to three connection pins, two of which are visible in FIG. 1 as the connection pins 122 and 123. Each of the pins is appropriately connected to the connection member 110 as by threading, as is shown in detail in connection with pin 122. Note that members 120 and 121 are appropriately connected together as by the bolt 125, washer 126 and lock washer 127.

The movable and stationary contact assemblies in FIG. 1 are shown in a disconnected position. In order to close the interrupter, the operating rod 120 moves the movable contact assembly to the right, so that the contact fingers move to the position illustrated in phantom lines relative to the stationary contact assembly 20. When this occurs, the arcing contact tip 101 of cylinder 100 engages the arc runner 22 of the stationary contact assembly, and the member 100 moves to the left relative to members 51 and 53, and the spring 114 is compressed. The longer contact members, such as contact members 53, then engage the main contact surface 21 of stationary contact 20, while the contact members 51 serve as transfer contacts and sit atop the Teflon ring 24 during normal current-carrying conditions.

In order to open the interrupter, the operating rod 120 moves to the left, so that the contact members 51 and 53 move to the left. The arcing contact 101 engages the arc runner, however, until the shoulder 104 picks up extension region 103 of the arcing contact cylinder. Prior to this time, the first contact ring region defined by the contact flats of shorter contacts 51 engage the outer surface of cylinder 100, thereby forming an electric circuit from coil 25 through the arc runner 22, the arcing contact 100, and to the main terminals of the device connected to the main contact holder 50.

When the main contact cluster containing members 53 finally separates from the conductive surface 121, current flows through the arcing contacts, including members 22 and 101, so that when the arcing contact 101 is finally moved to the left, the arc spinning mode of interruption can be initated.

In carrying out the invention, the configuration of the contact elements 51 and 53 could take other forms. By way of example, it would be possible to use only a single spring member rather than the hairpin or U-shaped members, with alternate members having different lengths to serve the functions of main contact fingers and transfer contact fingers. Similarly, an arrangement could be used whereby a continuous wire bent to the shape of the longer wire members 53 could be used, interleaved with shorter single contact segments.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A contact assembly comprising a first contact comprising a plurality of parallel spring wire members fixed in a tubular cluster around a support body; said plurality of spring wire members consisting of a first plurality of members all terminating in a first plane and a second plurality of members terminating in a second plane axially spaced from said first plane; each of said plurality of members having an inwardly reentrant bend at their ends to define first and second internal contact ring regions which are axially spaced from one another and which have given diameters; and a second contact which is coaxial with said first contact and which is adapted to engage said first contact by moving telescopically into the interior of said first contact; said second contact having an outer diameter larger than said given diameters of said contact ring regions.

2. The contact assembly of claim 1 wherein each of said spring wire members comprises a U-shaped spring member having a base and first and second freely extending parallel arms extending from said base in which said base of said U shape lies adjacent a respective one of said first or second planes.

3. The contact assembly of claim 2 wherein; the bases of each of said U-shaped members lie on a diameter which is less than the diameter of the cylindrical shape defined by said arms of said members; said contact members in said tubular cluster being alternately of said first plurality of members and then of said second plurality of members; the arms of said members of said second plurality of members straddling the adjacent arms of adjacent members of said first plurality of members.

4. The contact assembly of claim 3 wherein each of said arms has the same cross-section and wherein the arms of each of said members are spaced a distance equal to twice their thickness in a peripheral direction around said tubular cluster.

5. The contact assembly of claim 1, 2, 3 or 4 wherein said members are circular in cross-section.

6. The contact assembly of claim 1, 2, 3 or 4 wherein said first and second internal contact ring regions have flats which are parallel to the axis of said tubular cluster.

7. The contact assembly of claim 5 wherein said first and second internal contact ring regions have flats which are parallel to the axis of said tubular cluster.

8. An arc spinner interrupter comprising a first contact comprising a plurality of parallel spring wire members fixed in a tubular cluster around a support body; said plurality of spring wire members consisting of a first plurality of fingers all terminating in a first plane and a second plurality of members terminating in a second plane axially spaced from said first plane; each of said plurality of members having an inwardly reentrant bend at their ends to define first and second internal contact ring regions which are axially spaced from one another and which have given diameters; and a second tubular contact which is coaxial with said first contact and which is adapted to engage said first contact by moving telescopically into the interior of said first contact; said second contact having an outer diameter larger than said given diameters of said contact ring regions; said first contact further including a first arcing contact cylinder axially slidably disposed within said cluster and making sliding engagement with said first and second contact ring regions; said second contact having a second arcing contact engageable with said first arcing contact; biasing means connected to said arcing contact cylinder and biasing said cylinder toward engagement with said second arcing contact; said first and second contact ring regions being spaced such that when said first and second contacts are moved axially away from one another, said first contact ring region engages said arcing contact cylinder while said second contact ring region engages said second contact, and whereby said first and second arcing contacts remain engaged when said second contact ring region separates from said second contact.

9. The contact assembly of claim 8 wherein each of said spring wire members comprise a U-shaped spring finger member having a base and first and second freely extending parallel arms extending from said base in which said base of said U shape lies adjacent a respective one of said first or second planes.

10. The contact assembly of claim 9 wherein the bases of each of said U-shaped members lie on a diameter which is less than the diameter of the cylindrical shape defined by said arms of said members; said contact members in said tubular cluster being alternately of said first plurality of members and then of said second plurality of members; the arms of said members of said second plurality of members straddling the adjacent arms of adjacent members of said first plurality of members.

11. The contact assembly of claim 10 wherein each of said arms has the same cross-section and wherein the arms of each of said members are spaced a distance equal to twice their thickness in a peripheral direction around said tubular cluster.

* * * * *